US008469870B2

(12) United States Patent
Nemoto

(10) Patent No.: US 8,469,870 B2
(45) Date of Patent: Jun. 25, 2013

(54) SWING ROTOR HAVING IMPROVED HOLDING PIN FOR CENTRIFUGAL SEPARATOR AND CENTRIFUGAL SEPARATOR INCLUDING THE SAME

(75) Inventor: Kenichi Nemoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 13/294,345

(22) Filed: Nov. 11, 2011

(65) Prior Publication Data

US 2012/0190527 A1 Jul. 26, 2012

(30) Foreign Application Priority Data

Nov. 12, 2010 (JP) ..... 2010-253723

(51) Int. Cl.
*B04B 5/02* (2006.01)

(52) U.S. Cl.
USPC ..... 494/20

(58) Field of Classification Search
USPC ..... 494/16–21, 31, 33, 43, 81; 422/548
See application file for complete search history.

(56) References Cited

U.S. PATENT DOCUMENTS

| | | | | | |
|---|---|---|---|---|---|
| 2,604,261 | A | * | 7/1952 | Silverstolpe | 494/20 |
| 3,028,075 | A | * | 4/1962 | Blum | 494/20 |
| 3,722,791 | A | * | 3/1973 | Wright | 494/20 |
| 3,762,635 | A | * | 10/1973 | Hankey | 494/20 |
| 4,009,824 | A | * | 3/1977 | Wright | 494/20 |
| 4,141,489 | A | * | 2/1979 | Wright | 494/20 |
| 4,147,294 | A | * | 4/1979 | Davidson et al. | 494/20 |
| 4,314,662 | A | * | 2/1982 | Uchida | 494/20 |
| 4,314,663 | A | * | 2/1982 | Ouchi | 494/16 |
| 4,344,563 | A | * | 8/1982 | Romanauskas | 494/20 |
| 4,391,597 | A | * | 7/1983 | Piramoon et al. | 494/20 |
| 4,501,565 | A | * | 2/1985 | Piramoon | 494/85 |
| 4,548,596 | A | * | 10/1985 | Sutton et al. | 494/20 |
| 5,681,258 | A | * | 10/1997 | Lowe et al. | 494/20 |
| 6,712,750 | B2 | * | 3/2004 | Hayasaka et al. | 494/20 |
| 8,323,170 | B2 | * | 12/2012 | Piramoon | 494/20 |
| 2002/0048515 | A1 | * | 4/2002 | Hayasaka et al. | 416/175 |
| 2012/0190527 | A1 | * | 7/2012 | Nemoto | 494/33 |

FOREIGN PATENT DOCUMENTS

| | | | | |
|---|---|---|---|---|
| JP | 2002113388 | A | | 4/2002 |
| JP | 2005152819 | A | * | 6/2005 |
| JP | 2006150311 | A | * | 6/2006 |
| JP | 2009268951 | A | * | 11/2009 |
| JP | 2012101203 | A | * | 5/2012 |

* cited by examiner

*Primary Examiner* — Charles E Cooley
(74) *Attorney, Agent, or Firm* — Kenealy Vaidya LLP

(57) ABSTRACT

A swing rotor for a centrifugal separator, the swing rotor including: a hub; and a rotor body disposed around the hub, wherein a plurality of pairs of arms are disposed at the rotor body, wherein a holding pin configured to hold a bucket is disposed to the arm, wherein an engagement portion which is configured to be supported by the holding pin is formed to the bucket, and wherein a sliding surface of the holding pin with an engagement portion of the bucket is formed such that a width of a contact area, which is an area that the holding pin contacts with the engagement portion of the bucket, in an axial direction when the bucket does not swing differs from a width of the contact area in the axial direction when the bucket reaches a horizontal position by swinging during a centrifugal separation operation.

10 Claims, 13 Drawing Sheets

SWING ROTOR HAVING IMPROVED HOLDING PIN FOR CENTRIFUGAL SEPARATOR AND CENTRIFUGAL SEPARATOR INCLUDING THE SAME

CROSS-REFERENCE TO RELATED APPLICATIONS

This application claims priority from Japanese Patent Application No. 2010-253723 filed on Nov. 12, 2010, the entire contents of which are incorporated herein by reference.

TECHNICAL FIELD

Aspects of the present invention relates to a swing rotor for a centrifugal separator and a centrifugal separator, and particularly, to improvement in a shape of a holding pin which is formed at a swing rotor and is for holding a swinging bucket.

BACKGROUND

Swing-rotor-type centrifugal separators, which are used for conducting a test on blood or urine and rotate a sample container accommodated in a bucket capable of swinging, have been used. Many swing-rotor-type centrifugal separators have maximum rotation speeds of about 3000 rpm to 5000 rpm. A swing rotor has a hub extending coaxially with a drive shaft disposed in a centrifugal chamber, a rotor body disposed around the hub, and a plurality of arms extending from the rotor body. As for the arms, a plurality of pairs of arms are provided, arms of each pair face each other, and each pair of arms supports a bucket for holding a sample container such that the bucket is rotatable. There are various kinds of swing rotors. In general, holding pins are formed at the arms of a swing rotor, pin receiving portions are formed at both sides of each of the buckets for accommodating samples, and the buckets are held to the holding pins by the pin receiving portions. The holding pins are often disposed to be aligned with a swing center axis, and are fixed on the swing rotor side. However, the holding pins may be formed on the bucket side.

If the swing rotor rotates in the centrifugal chamber, each bucket supported or hooked by each pair of holding pins provided to the arms swings in a horizontal direction around the corresponding pair of holding pins by a centrifugal force, such that centrifugal separation of a sample in a sample container is performed. During a centrifugal separation operation, it is required to stably hold the sample container in a constant posture. For this reason, it is general to accommodate a plurality of sample containers in a dedicated rack and load the rack in a bucket.

The dedicated rack is designed according to an internal shape of a bucket to be loaded thereon, and is manufactured by using, for example, polypropylene or polyacetal resin. Further, the rack is configured to have a plurality of insertion holes with one end enclosed, according to the kind of sample containers to be accommodated therein. For example, plastic or glass test tubes are generally used as sample containers used for a test on blood or urine, and a rack is formed in a shape capable of vertically disposing the sample containers at even intervals. Volumes of samples contained in the sample containers such as test tubes are often uneven, and thus there may be a variation in a center of gravity of the rack in which the sample containers has been set. Particularly, in a case of sample containers called vacuum blood-collecting vessels used for blood tests, a difference in mass between the sample containers easily occurs due to a difference in blood quantity or a difference in specific gravity of blood.

For this reason, when the sample containers are accommodated in the dedicated rack, it is important to confirm a mass of each sample container so as to check whether a total mass of the sample containers to be accommodated in each rack is within an allowable value range and to confirm whether a mass difference between racks loaded at rotation positions facing the rotation axis of the swing rotor is within an allowable value range of the centrifugal separator. Also, it is important to adjust alignment of sample containers such that the center position when the swing rotor is seen from the above are aligned with the center axis lines of holding pins at the greatest extent.

In general, in an automatic centrifugal apparatus which automatically carries sample containers in and out, it is relatively easy to adjust a total mass in a dedicated rack or a mass difference between racks facing each other. However, in a case where a dedicated rack, in which a plurality of sample containers is accommodated manually, it is very difficult to dispose the sample containers in consideration of the center of gravity of the rack. For this reason, in order to prevent sample containers from being randomly accommodated in the rack, for example, the order or positions of the sample containers to be accommodated in the rack has been designated. However, even if the order or positions are designated, the center of gravity of the bucket may not be aligned with the center axis lines of the holding pins, and in some cases, the bucket may rotate in an inclined state (a state in which the center of gravity is different from an ideal position).

Further, sliding based on contact by the holding pins and the pin receiving portions of the bucket is required in a swing rotor, and in a case where the rotation of the swing rotor stops, the bucket is required to accurately return to an original position. However, in a case where influence of friction is great, the bucket may not smoothly swing, and in the worst case, the bucket may stop in the middle. Particularly, in a centrifugal apparatus which automatically carries sample containers in and out, if a bucket does not return to an original position after swinging, not only a problem may occur when carrying the sample containers in and out but also the samples may be damaged. In order to solve these problems, it is necessary to frequently apply lubricant grease on the holding pins so as to reduce friction. However, in an automatic centrifugal apparatus which is required to be continuously operated, frequent grease application increases the maintenance time of the apparatus, and is cumbersome. For this reason, users demand that this maintenance interval should be made further longer.

A countermeasure technology for these problems is disclosed in related-art. In related-art, a front edge of a holding pin, which is provided at a front edge of each arm, has a tempered shape in which the front edge widens radially, and the holding pin is disposed in a normal direction, such that the holding pin is brought into point contact with a pin receiving portion of a bucket so as to reduce sliding resistance.

In a rotor for a centrifugal separator disclosed in related-art, the sliding resistance of the holding pin is reduced. However, since the holding pin is in almost point contact with the pin receiving portion during a centrifugal separation operation, a local surface pressure becomes high. Therefore, in a case where it is desired to increase the mass of the bucket, it is difficult to secure a sufficient strength. Further, in a case of a bucket which accommodates a plurality of sample containers, a bucket may be held in an inclined state according to a center of gravity during a centrifugal separation operation, such that the position of the contact area (almost point contact) between the holding pin and the pin receiving portion of the bucket becomes unstable.

The present invention was made considering the above-mentioned circumferences, and an object of the present invention is to provide a swing rotor for a centrifugal separator and a centrifugal separator which suppress sliding resistance during swinging of a bucket, so as to prevent defect in swing.

Another object of the present invention is to provide a swing rotor for a centrifugal separator and a centrifugal separator which are capable of stably maintaining a swing state during a centrifugal separation operation even when a slight variation occurs in a center of gravity of a bucket.

Another object of the present invention is to provide a swing rotor for a centrifugal separator and a centrifugal separator which are capable of suppressing sliding resistance of a bucket during swinging, suppressing an increase in manufacturing cost to the minimum, and reducing regular maintenance, only by adding a simple machining process to the configuration according to the related-art.

SUMMARY

According to an aspect of the present invention, there is provided A swing rotor for a centrifugal separator, the swing rotor including: a hub configured to be connected to a drive shaft; and a rotor body disposed around the hub, wherein a plurality of pairs of arms are disposed at the rotor body such that arms of each pair face each other, wherein a holding pin configured to hold a bucket such that the bucket is capable of swinging is disposed to the arm such that the holding pin extends toward an arm facing the arm to which the holding pin is disposed, wherein an engagement portion which is configured to be supported by the holding pin is formed to the bucket, and wherein a sliding surface of the holding pin with an engagement portion of the bucket is formed such that a width of a contact area, which is an area that the holding pin contacts with the engagement portion of the bucket, in an axial direction when the bucket does not swing differs from a width of the contact area in the axial direction when the bucket reaches a horizontal position by swinging during a centrifugal separation operation.

According to another aspect of the present invention, there is provided a centrifugal separator comprising: a swing rotor that holds a plurality of buckets for holding samples such that the buckets are capable of swinging, the swing rotor including, a hub configured to be connected to a drive shaft; a rotor body disposed around the hub; the plurality of buckets that are held by the swing rotor such that the buckets are capable of swinging; a drive that rotates the swing rotor; and a rotor chamber where a rotation shaft of the drive is disposed and that is for rotating the swing rotor, wherein a plurality of pairs of arms are disposed at the rotor body such that arms of each pair face each other, wherein a holding pin configured to hold the bucket such that the bucket is capable of swinging is disposed to the arm such that the holding pin extends toward an arm facing the arm to which the holding pin is disposed, wherein an engagement portion which is configured to be supported by the holding pin is formed to the bucket, and wherein a sliding surface of the holding pin with an engagement portion of the bucket is formed such that a width of a contact area, which is an area that the holding pin contacts with the engagement portion, in an axial direction when the bucket does not swing differs from a width of the contact area in the axial direction when the bucket reaches a horizontal position by swinging during a centrifugal separation operation.

DETAILED DESCRIPTION

[First Exemplary Embodiment]

Figure 1:
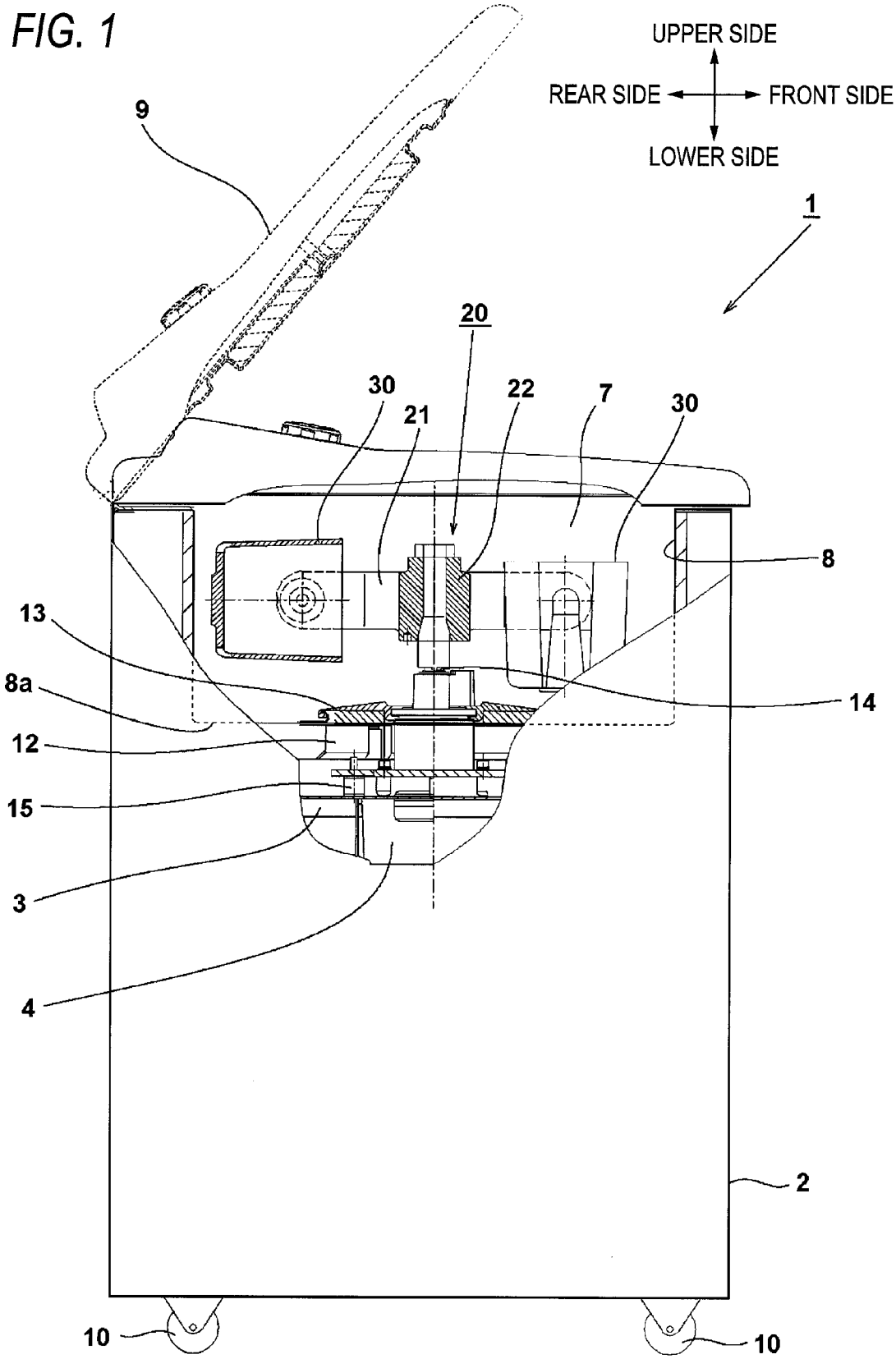
FIG. 1 is a side view illustrating a centrifugal separator 1 according to an exemplary embodiment of the present invention, in which a portion thereof is shown in a cross-sectional view.

Hereinafter, exemplary embodiments of the present invention will be described with reference to the accompanying drawings. Throughout the drawings, identical portions are denoted by the same reference symbols, and a redundant description will not be repeated. In this specification, a front side, a rear side, an upper side, and a lower side will be described with reference to directions shown in the drawings. FIG. 1 is a side view illustrating a centrifugal separator 1 according to an exemplary embodiment of the present invention, in which a portion thereof is shown in a cross-sectional view. In FIG. 1, for understanding of states of a bucket during stop and rotation of a rotor, both of a state of a bucket 30 during the rotation (a bucket 30 on the left side of FIG. 1), and a state of a bucket 30 during the stop (a bucket 30 on the right side of FIG. 1) are shown.

The centrifugal separator 1 includes a swing rotor 20 and a motor 4 which is a drive unit for rotating the swing rotor 20. A housing 2 constitutes an outer case of the centrifugal separator 1. Inside the housing 2, a controller (not shown) for driving and controlling the motor 4 and the like is provided.

The motor 4 includes a drive shaft 14, and is fixed to a horizontal plate 3 provided in the housing 2 by a motor supporting portion 15 made of anti-vibration rubber or the like which absorbs vibration. A rotor chamber 7 is defined by a bowl 8, which has a cylindrical shape opened upward for accommodating the swing rotor 20 and includes a bottom 8*a*.

The bowl 8 is fixed to the horizontal plate 3 through a spacer 12, and the upper opening is closable with a door 9. Further, a heat insulation material is provided on an outer circumference side of the bowl 8 defining the rotor chamber 7 which accommodates the swing rotor 20, and in an outer circumference portion of the heat insulation material, a metal protector (protective wall), which is not shown, is disposed. In the rotor chamber 7, the drive shaft 14 of the motor 4 is disposed to protrude through a through-hole formed in the bottom 8*a* of the bowl 8. A position of the bowl 8 where the drive shaft 14 protrudes (through-hole not shown) is closed by a seal rubber 13.

The door 9 is fixed to the housing 2 by a hinge such that the door 9 is openable and closable on the upper side of the rotor chamber 7, and hermetically closes the rotor chamber 7. Further, by opening the rotor chamber 7 by opening the door 9 as shown in FIG. 1, the swing rotor 20 is attachable to and detachable from the drive shaft 14. Although not shown, at an edge portion of the door 9, a locking mechanism for maintaining the closed state of the door 9 is provided. This locking mechanism is locked so as to prevent a user from erroneously opening the door 9 during the rotation of the swing rotor 20.

The swing rotor 20 is configured so as to be rotatable coaxially with the drive shaft 14, and includes a rotor body 21 and a plurality of buckets 30 which is held by arm portions extending from the rotor body 21. The number of mountable buckets 30 is generally an even number, and is four in the present exemplary embodiment.

Figure 2:
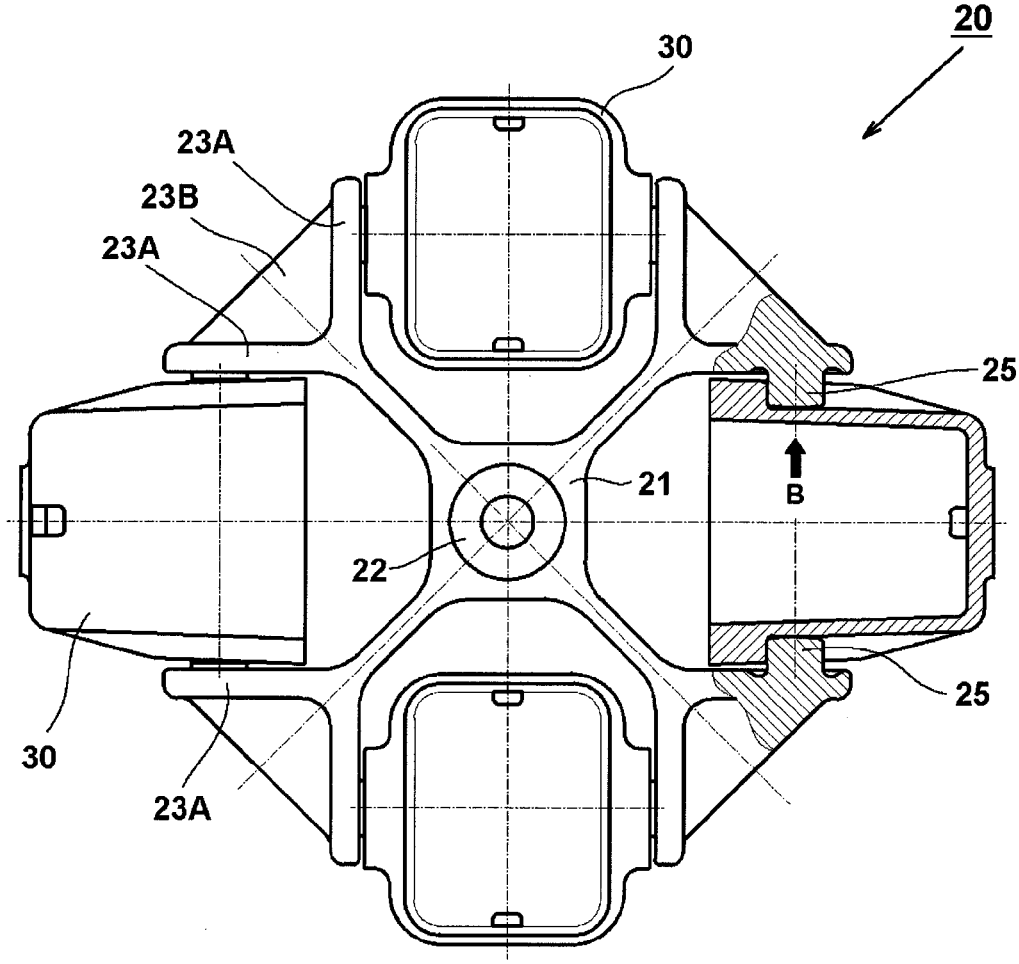
FIG. 2 is a top view of a swing rotor 20 according to the exemplary embodiment of the present invention.

Now, a shape of the swing rotor 20 will be described with reference to FIG. 2. FIG. 2 is a top view of the swing rotor 20 according to the exemplary embodiment of the present invention. The swing rotor 20 includes a hub 22, and the rotor body 21 extending around the hub 22 in four directions in a cross shape when seen from the above. The rotor body 21 is generally formed by a precision casting of stainless case steel or aluminum alloy, and takes a manufacturing method of cutting only portions requiring system accuracy by a machining process, thereby reducing the manufacturing cost. The hub 22 is configured in a substantially cylindrical shape, and is a portion to be connected to the drive shaft 14. Portions of the rotor body 21 extending from the vicinity of the outer circumference of the hub 22 in four directions are disposed around the rotation axis (rotation center) of the hub 22 at intervals of 90 degrees when seen from the above, and are configured in a shape such that the extension portions become rotation objects around the rotation axis.

In an outer circumference side portion of the rotor body 21, arms 23A divided into two parts at intervals of about 90 degrees and ribs 23B joining the arms 23A are provided. One of the arms 23A is disposed to extend in a direction perpendicular to the rotation axis and extend in parallel to an arm 23A facing thereto with a bucket 30 interposed therebetween, and these parallel arms 23A form one arm portion and support the bucket 30. In order to support the buckets 30, a holding pin 25 having a substantially cylindrical shape extends from each arm 23A. The extension direction of the holding pin 25 is a tangential direction of a rotation trajectory of the rotor body 21 (a direction towards an arm 23A facing the arm 23A to which the holding pin 25 is provided) and is a direction normal to the rotation axis of the hub 22.

Figure 3:
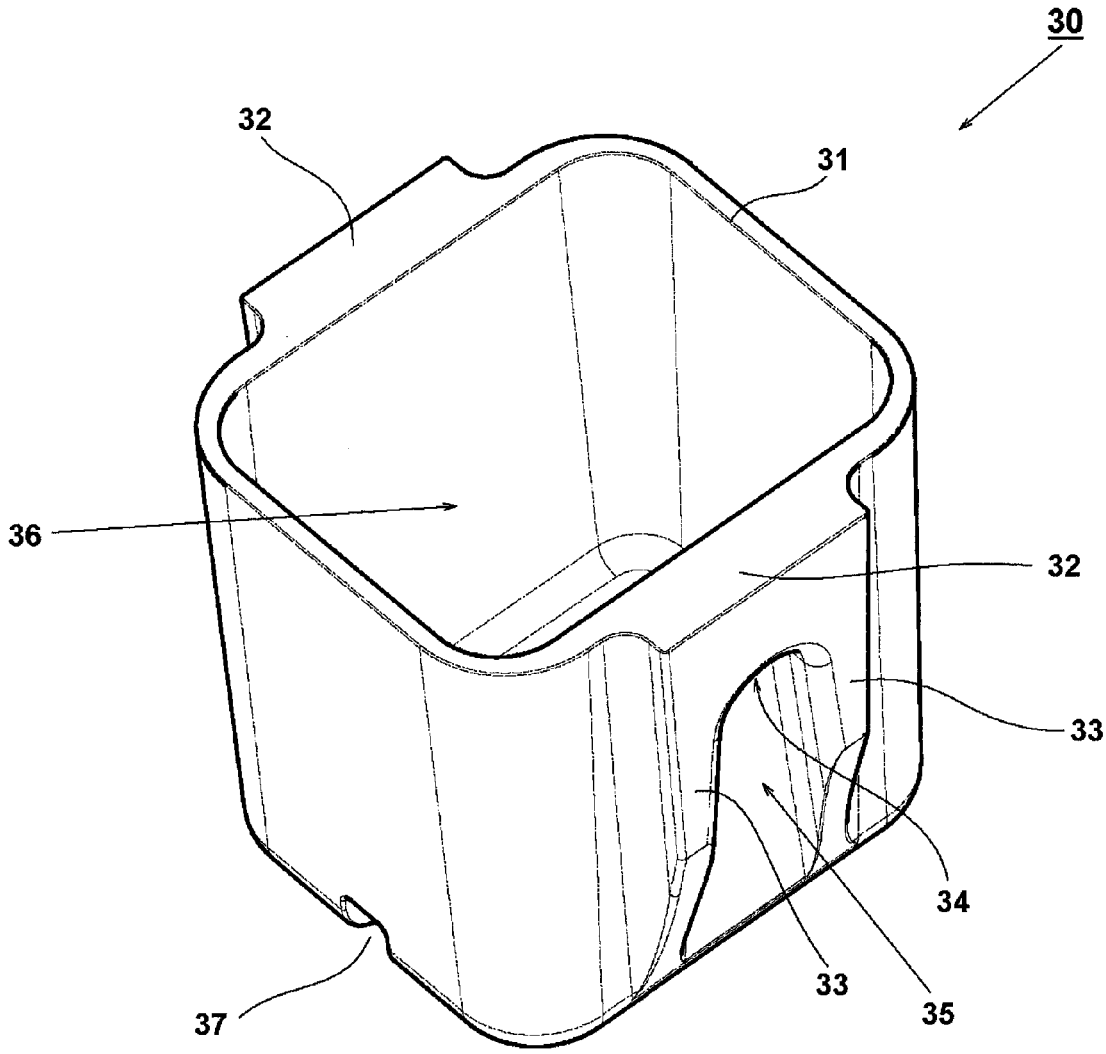
FIG. 3 is a perspective view illustrating a shape of a bucket 30 to be set in the swing rotor 20 according to the exemplary embodiment of the present invention.

Now, a shape of a bucket 30 will be described with reference to FIG. 3. FIG. 3 is a perspective view illustrating a shape of a bucket 30 to be set in the swing rotor 20 according to the exemplary embodiment of the present invention. Each bucket 30 is manufactured by integral molding of a metal such as an aluminum alloy, and each bucket 30 of the present exemplary embodiment has a cup shape having a substantially rectangular opening 31 as seen from the above. In a pair of faces of the opening 31 that face each other, thick portions 32 having an increased thickness are partially formed, and a dent 35 is formed on the lower side of one thick portion 32. The dent 35 is formed in an area interposed between two guide ribs 33 which are substantially parallel. The guide ribs 33 serve as guides for guiding a holding pin 25 when the bucket 30 is loaded on and unloaded from the swing rotor 20. In an upper end of the dent 35, on the lower side of the thick portion 32, an arc-shaped pin receiving portion 34 is formed. An inner wall of the arc-shaped pin receiving portion 34 may have a semi-cylindrical shape slightly larger than the outer diameter of each holding pin 25 (FIG. 2).

In FIG. 3, only the guide ribs 33 and the pin receiving portion 34 connected to one thick portion 32 are shown. However, even in the thick portion 32 located on the opposite side, similarly, the guide ribs 33 and a pin receiving portion 34 are formed. It can be understood from FIG. 3 that each bucket 30 is hung and supported by the holding pins 25 formed at the arms 23A of the swing rotor 20. Each bucket 30 is attachable to and detachable from the swing rotor 20, and it is possible to unload each bucket 30 from the swing rotor 20 by pulling the corresponding bucket 30 upward from the swing rotor 20 (in an upper direction parallel to the axis direction). Meanwhile, each bucket 30 can be easily loaded to the swing rotor 30 by performing an operation opposite to the operation of unloading each bucket 30.

Each bucket 30 has a space 36 for accommodating a rack having a plurality of sample containers contained therein, which will be described later. In the vicinity of the bottom of the bucket 30, a hole portion 37, which is connected from the outer circumference of the bucket up to the space 36, is formed. Therefore, water and the like coming in the space 36 can be discharged therefrom. In the present exemplary embodiment, each bucket 30 has a cuboid shape having a substantially rectangular opening 31. However, the present invention is not limited thereto. Each bucket may have a cylindrical shape with a circular opening, or may have other arbitrary shapes.

Figure 4:
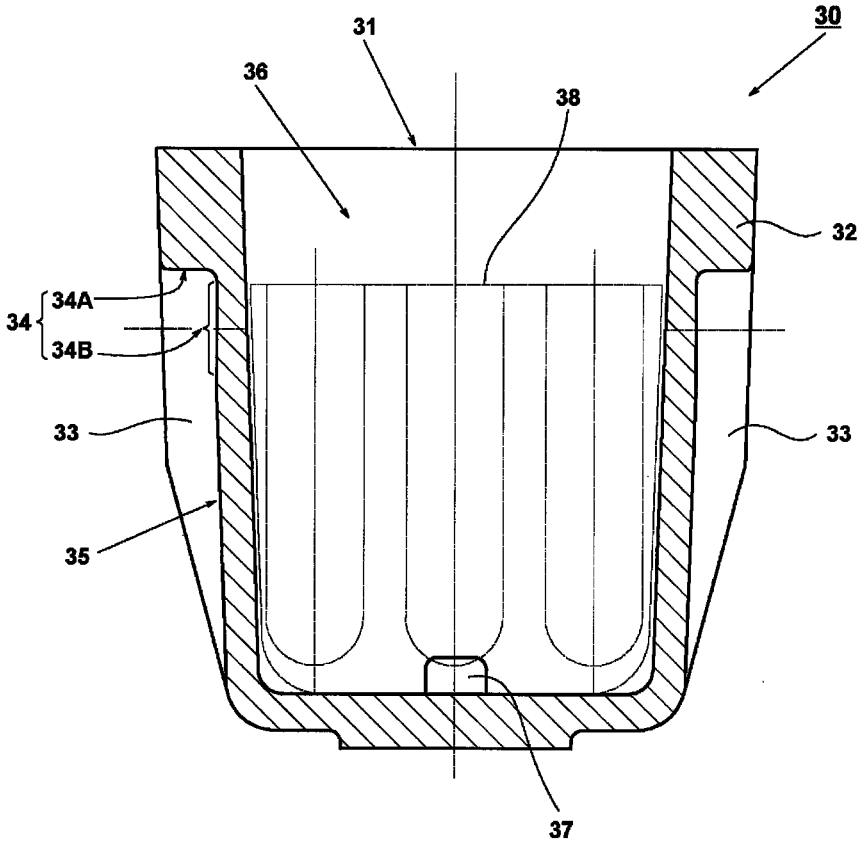
FIG. 4 is a longitudinal cross-sectional view of the bucket 30 to be set in the swing rotor 20.

FIG. 4 is a longitudinal cross-sectional view of a bucket 30 to be set in the swing rotor 20. FIG. 4 is a cross-sectional view at a position passing a center of an arc-shaped pin receiving portion. Two guide ribs 33 are formed below the thick portion 32 of the bucket 30, and the pin receiving portion 34 is formed between the guide ribs 33. The pin receiving portion 34 includes a holding portion 34A for determining a vertical position, and an abutting surface 34B for suppressing a deviation in a horizontal position with respect to the rotor body 21. As understood from the perspective view of FIG. 3, it is preferable that the inner wall of the pin receiving portion 34 is formed in a semi-cylindrical shape substantially similar to the shape of (about an upper half) the holding pin 25 having a substantially cylindrical shape, and it is preferable that the curvature of the inner wall of the holding portion 34A is larger than the curvature of the holding pin 25 such that the bucket 30 is capable of smoothly swinging. It is preferable to set gaps between the holding pin 25 and the guide ribs 33 to sufficient gaps such that the bucket 30 is capable of smoothly swinging. In the space 36 of the bucket 30, a rack 38 for holding a plurality of sample containers (not shown) as shown by dotted lines is accommodated. The opening portion 37 is for preventing water and the like from being collected in the bucket 30.

Figure 5:
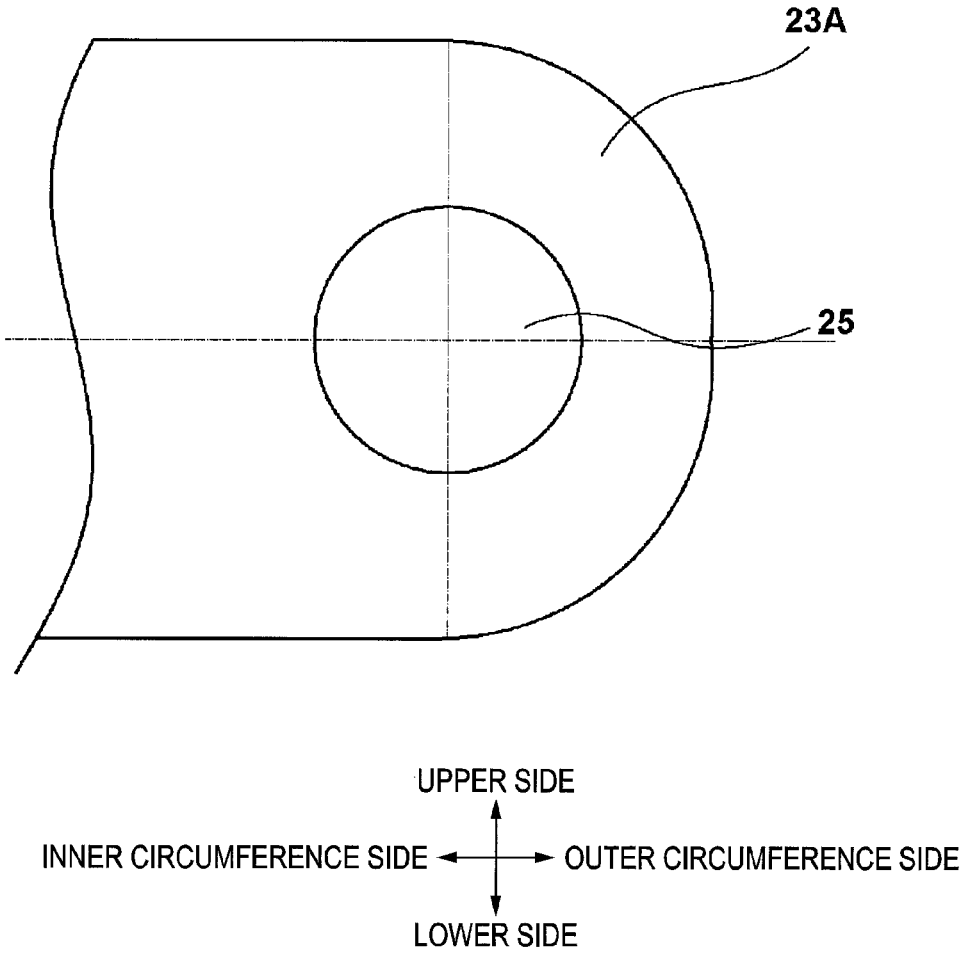
FIG. 5 is a partial side view of a holding pin 25 as seen from a direction B of FIG. 2.

Now, a shape of a holding pin 25 according to the present exemplary embodiment will be described with reference to FIGS. 5 to 9. FIG. 5 is a partial side view of a holding pin 25 as seen from a direction B of FIG. 2. The holding pin 25 has a substantially cylindrical shape protruding from the arm 23A. However, the holding pin 25 of the present exemplary embodiment is not completely cylindrical, and is formed such that a diameter of a base portion of the substantially cylindrical shape is slightly small, a diameter of the vicinity of the center, in the axial direction, of the substantially cylindrical shape is larger, and a diameter decreases from the vicinity of the center, in the axial direction, to a front edge portion of the substantially cylindrical shape.

Figure 13:
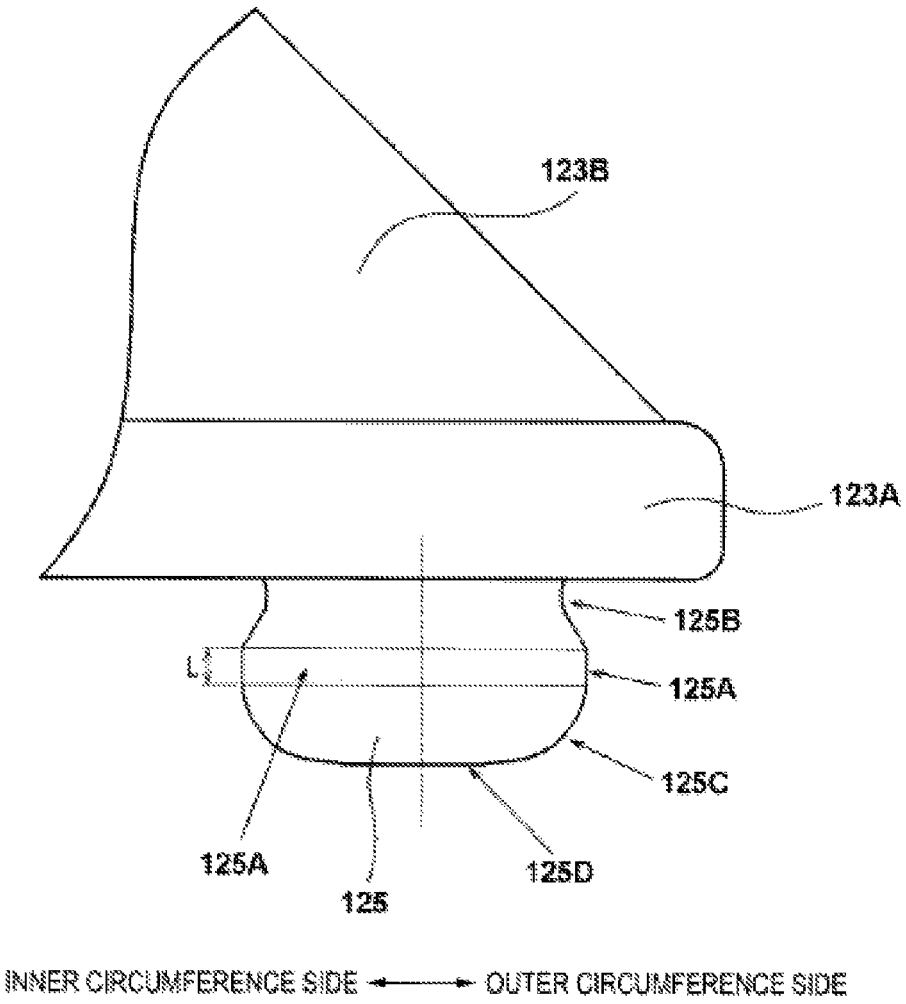
FIG. 13 Conventional Art
FIG. 13 is a top view of a portion including a holding pin 125 of a swing rotor of a centrifugal separator according to related art.

Now, a shape of a holding pin 125 according to related art will be described, prior to a description of the shape of the holding pin 25 of the centrifugal separator according to the present invention. FIG. 13 is a top view of a holding pin 125 of a centrifugal separator according to the related art. Shapes of arms 123A and ribs 123B are the same as those in the configuration described with reference to FIGS. 1, 2, and 5. The holding pin 125 is a member having a curved shape which is close to a spherical shape attached to the arm 123A rather than a cylindrical shape. In the holding pin 125, a sliding portion 125A, which contacts with the pin receiving portion 34 of the bucket 30, has a cylindrical surface. The sliding portion 125A has a predetermined width L in the axial direction of the pin receiving portion 34. The sliding portion 125A is a portion processed by, for example, a cutting process, so as to be flat in the axial direction (cylindrical surface), and the width L in the axial direction is constant over the entire sliding portion 125A in the circumferential direction.

From the sliding portion 125A to the arm 123A side, a narrowed portion 125B narrowed such that the outer diameter of the sliding portion 125A decreases is formed. This narrowed portion 125B is formed in order to make the machining process easy as well as reliably processing the width L of the sliding portion 125A. From the sliding portion 125A to the bucket 30 side, a narrowed portion 125C narrowed toward a front edge to have a curved shape as sheen in the cross-sectional view is formed. At the front edge of the holding pin 125, a flat surface 125D, which is configured to accurately contact with the abutting surface 34B of the bucket 30, is formed.

Figure 6:
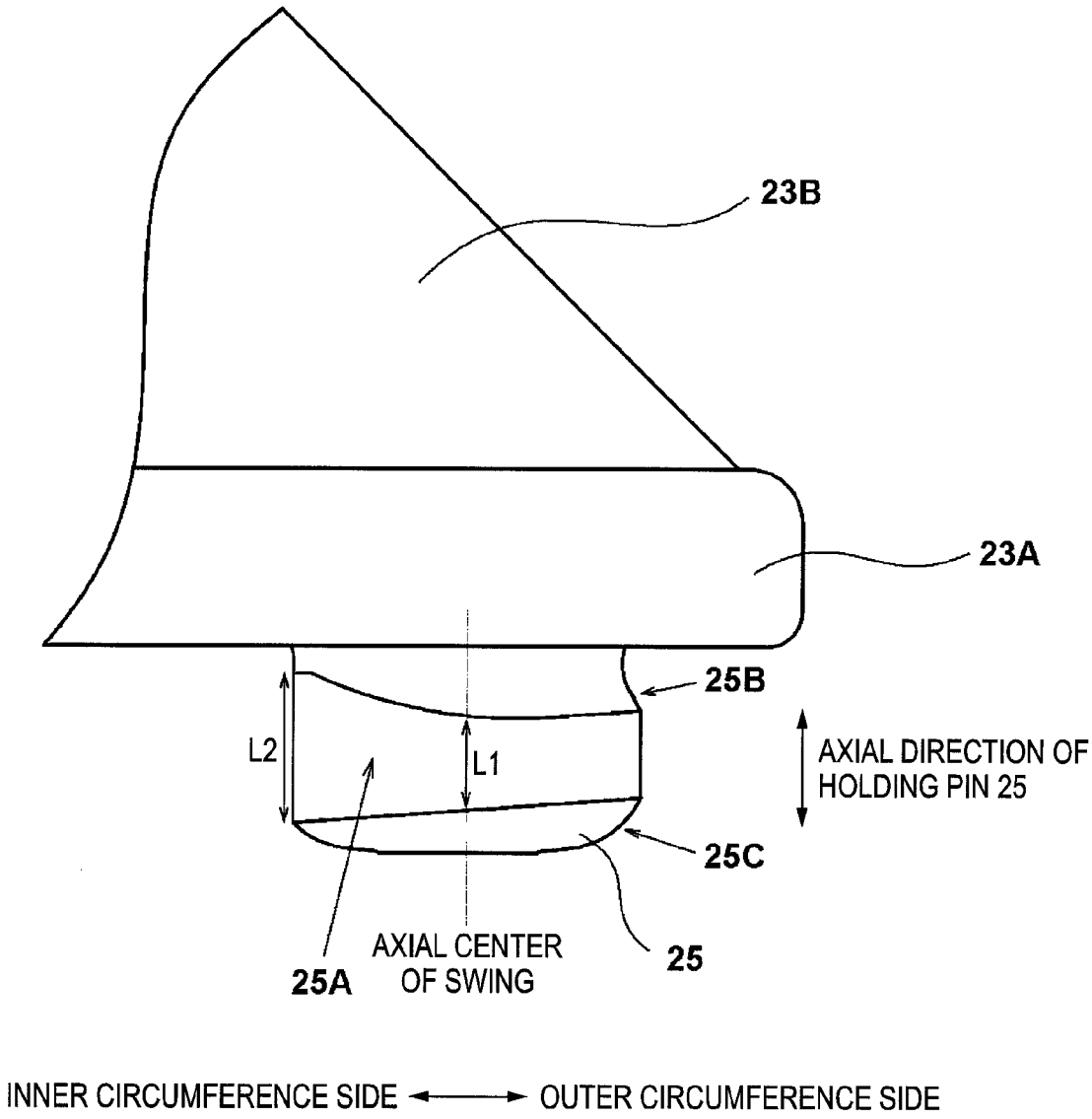
FIG. 6 is a top view of a portion including the holding pin 25 of FIG. 2.

Now, the shape of the holding pin 25 according to the present exemplary embodiment will be described. FIG. 6 is a partial top view of the holding pin 25 as seen from the above. As can be understood from FIG. 6, the holding pin 25 is similar to the holding pin 125 according to the related art shown in FIG. 13 in that, from the sliding portion 25A to the arm 23A side, a narrowed portion 25B is formed to have an outer diameter smaller than that of the sliding portion 25A, and a narrowed portion 25C is formed to have an outer diameter decreasing toward a front edge. However, a width of the sliding portion 25A which is configured to contact with the pin receiving portion 34 of the bucket 30 is not constant in a circumferential direction based on a swing center of the holding pin. When the swing rotor 20 stops, the pin receiving portion 34 of the bucket 30 contacts with the sliding portion 25A in the vicinity of an arrow L1 of FIG. 6. The contact area becomes a substantially straight-line-shaped small area. When the swing rotor 20 centrifugally operates (rotates at high speed), the pin receiving portion 34 of the bucket 30 contacts with the sliding portion 25A in the vicinity of an arrow L2 of FIG. 6. The contact area becomes a substantially line-shaped small area. It can be understood from FIG. 6 that the width of the sliding portion in the axial direction increases gradually from the vicinity of the arrow L1 to the vicinity of the arrow L2 of the sliding portion 25A.

Figure 7:
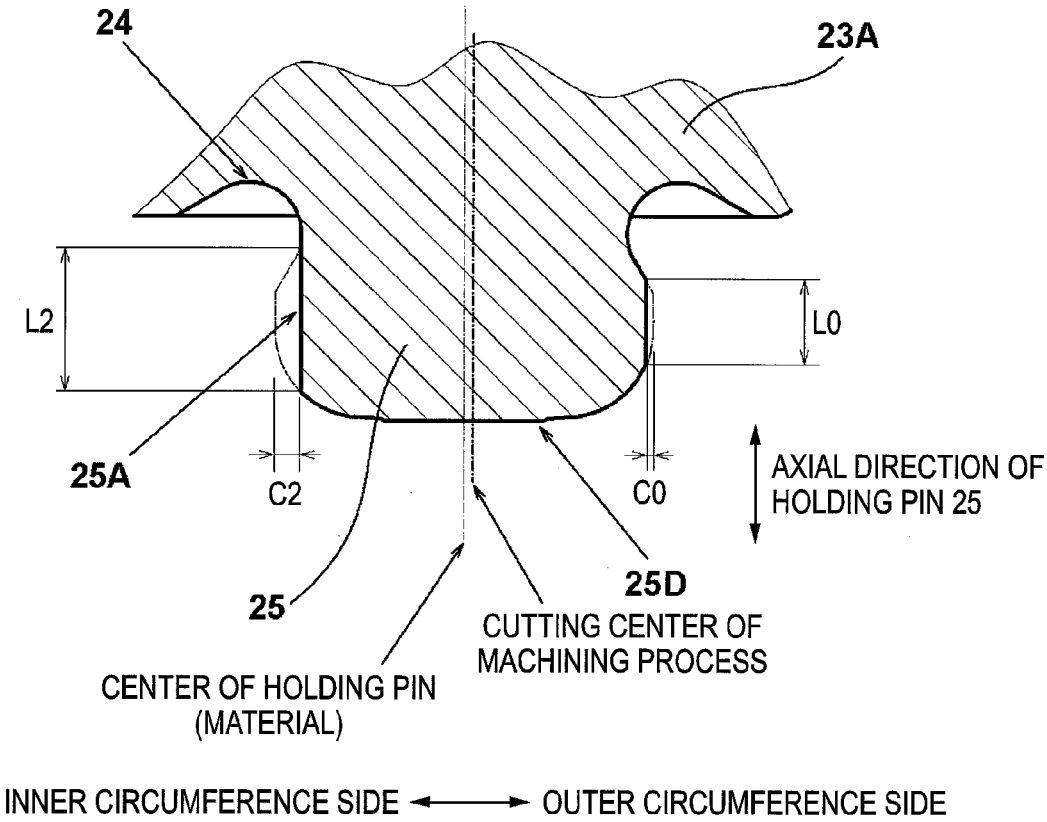
FIG. 7 is a horizontal cross-sectional view of a portion including the holding pin 25 of FIG. 2.

FIG. 7 is a horizontal cross-sectional view of the holding pin 25. The holding pin 25 is formed by integral molding of the same alloy as that of the arms 23A in view of strength. A shape shown by a dotted line is a shape before a cutting process is performed to the sliding portion 25A of the holding pin 25. The holding pin 25 is formed by a precision casting of stainless case steel or aluminum alloy and is formed in a desired shape and dimension by performing a cutting process to only the sliding portion 25A and a flat surface 25D. In the related art shown by FIG. 13, the cutting process to the sliding portion is performed in a state in which the center of the holding pin is in alignment with the center of the cutting of the machining process. However, in the present exemplary embodiment, the cutting process to the sliding portion 25A is performed in a state in which the center of the holding pin is intentionally offset with the center of the cutting of the machining process such that a cutting depth C2 at the inner circumference side of the swing rotor 20 is larger than a cutting depth C0 at the outer circumference side of the swing rotor 20. Specifically, when the cylindrical holding pin 25, which is manufactured in a state in which a sufficient process margin of 1 mm or more remains, is finished by the machining process, the process is performed in a state in which the center position of the cylindrical portion deviates slightly outward. By performing the process in this way, the sliding portion 25A can be configured so as to vary almost continuously from a contact line length L2 during centrifugal rotation to a contact line length L0 at the opposition position and satisfy a relation of L0<L2.

The flat surface 25D is a surface formed by a cutting process in a direction perpendicular to the axial direction of the holding pin 25, and is for restricting a movement of the bucket 30 in the axial direction. Therefore, it is preferable that the contact area is not excessively large and has a largeness so as not to disturb the swing of the bucket 30 relative to the swing rotor 20. At a position where the sliding portion 25A is connected to the arm 23A, a corner R portion 24 is formed. The corner R portion 24 is formed by providing an annular groove in the vicinity of the base of the holding pin 25 such that a cross-section shape of the groove becomes an R shape.

Figure 8:
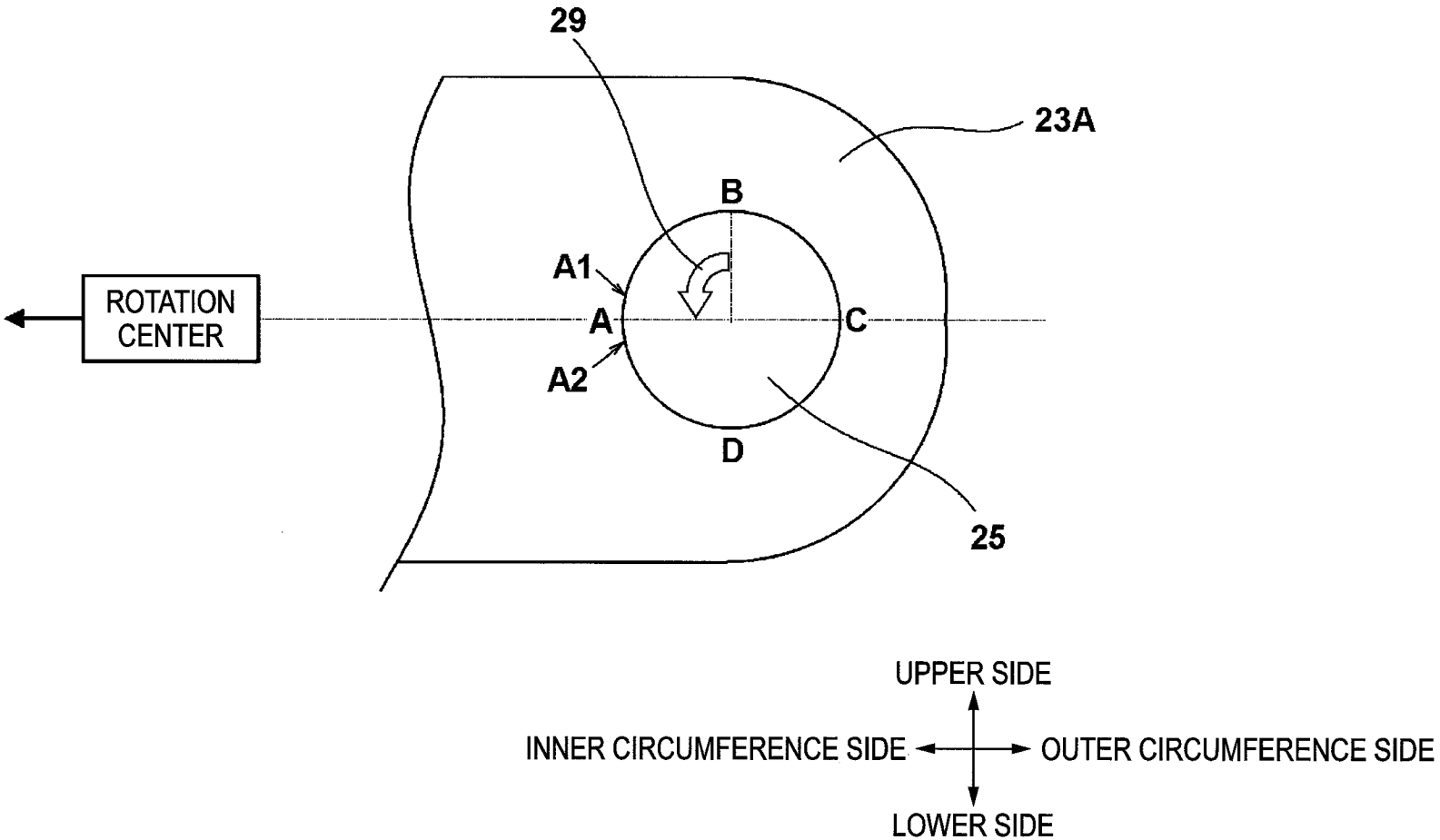
FIG. 8 is a view for explaining a position of the holding pin 25 in a circumferential direction.

Now, the shape of the sliding portion 25A of the holding pin 25 will be further described with reference to FIGS. 8 and 9. FIG. 8 is a view for explaining a position of a holding pin 25 in a circumferential direction. Reference symbols A to D of FIG. 8 denote a circumferential direction around the axial center of the holding pin 25. When the centrifugal separator stops such that the swing rotor 20 does not rotate, the holding portion 34A of the bucket 30 contacts with the holding pin 25 at a circumferential position B (contact position during stop). If the swing rotor 20 rotates from this state (circumferential position B), the bucket 30 swings slowly by a centrifugal force, such that the contact position of the holding portion 34A of the bucket 30 and the holding pin 25 moves from the circumferential position B toward the circumferential position A1 and is finally located at the circumferential position A (contact position during a centrifugal separation operation) as shown by a white arrow 29. In a case where a center of gravity of the bucket 30 is an ideal position, the contact position becomes the circumferential position A. However, if the center of gravity of the bucket 30 is slightly deviated due to a variation in specific gravity or volume in the samples in the sample containers accommodated in the rack, the contact position may become a circumferential position A1 or a circumferential position A2. In other words, according to the center of gravity of the bucket 30, the contact position when the swing rotor 20 rotates at high speed varies in a range from the circumferential positions A1 to A2 as seen in the circumferential direction of FIG. 8.

Figure 9:
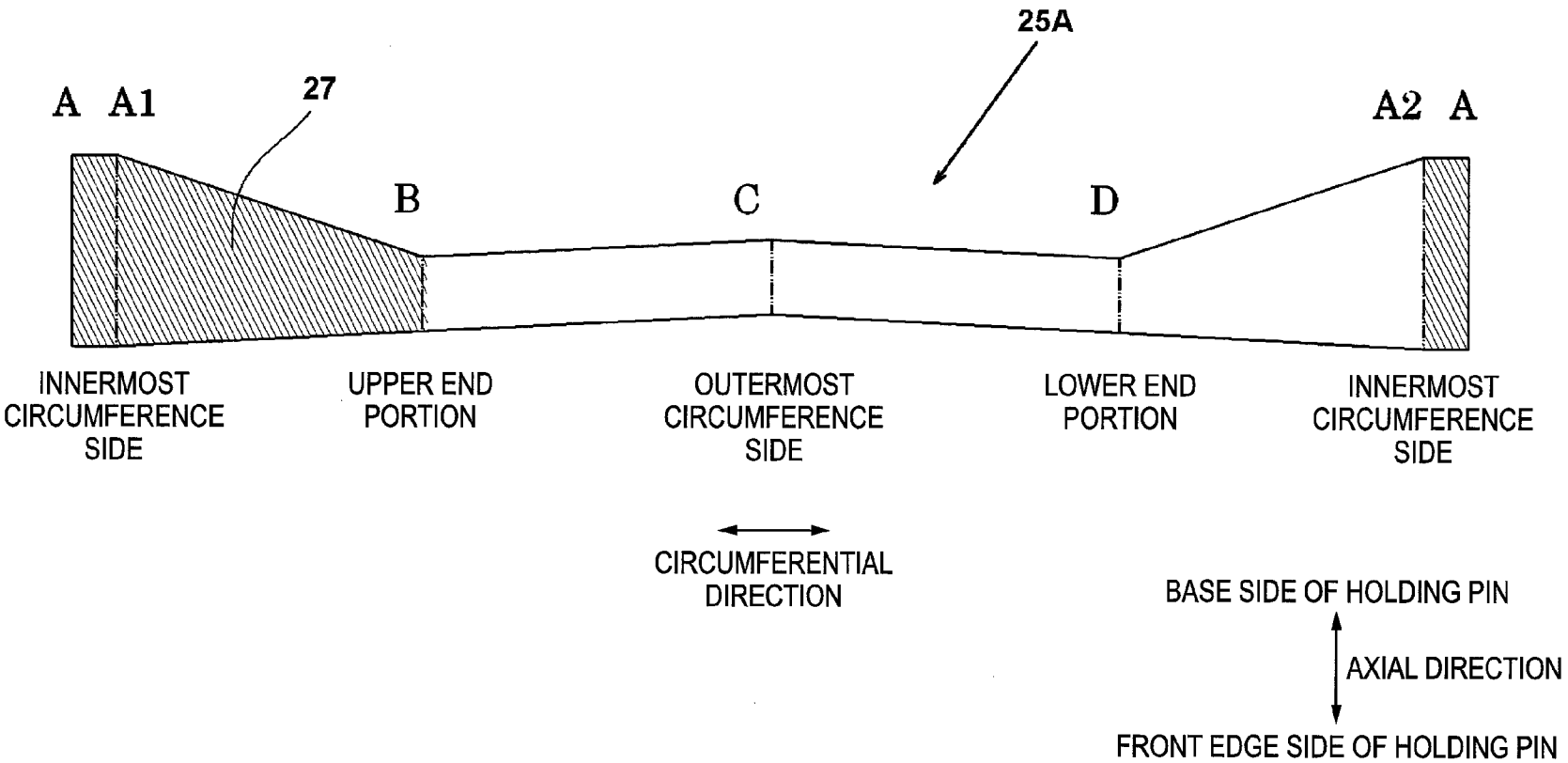
FIG. 9 is a development view illustrating an outer circumference surface of the holding pin 25 in the circumferential direction.

FIG. 9 is a development view illustrating the sliding portion 25A corresponding to 360 degrees from the circumferential position A of FIG. 8 in a clockwise direction. As can be understood from FIG. 9, in the circumferential direction, an area from the circumferential position B to the circumferential position A is the contact area which is an area that the holding portion 34A of the bucket 30 and the holding pin 25 contacts. Further, a portion from the circumferential position A to the circumferential position A2 may contact with the holding portion 34A of the bucket 30 depending on the center of gravity. In FIG. 9, a contact area 27 of the holding portion 34A of the bucket 30 and the holding pin 25 is shown by hatching. It can be understood from FIG. 9 that the width of the contact area in the axial direction when the swing rotor 20 stops (circumferential position B) is narrower than the width of the contact area in the axial direction when the swing rotor 20 rotates at high speed (position between the circumferential position A1 to the circumferential position A2). Meanwhile, it is preferable that the contact area during the rotation at high speed is almost constant in any position from the circumferential position A1 to the circumferential position A2.

According this configuration, during the centrifugal separation operation, the length in the axial direction of the contact area (substantially close to line contact) of the holding portion 34A of the bucket 30 and the sliding portion 25A of the holding pin 25 becomes maximum, even if a large centrifugal force is applied, it is possible to stably support the bucket 30. Further, in a case where loading of the sample containers of the rack 38 accommodated in the bucket 30 is not even and the misalignment with the center axis of the holding pin 25 occurs, even if the holding portion 34A of the bucket 30 and the sliding portion 25A contact with each other in any position from the circumferential position A1 to the circumferential position A2, the largeness of the area of the contact is almost constant. Therefore, it is possible to stably hold the bucket 30 without influence on an increase or decrease in surface pressure by the centrifugal force. Furthermore, in a case where the rotation stops, the bucket 30 returns to the original position and is supported by a portion in which the length, in the axial direction, of a contact area (almost close to line contact) of the sliding portion 25A of the holding pin 25 is the shortest. Therefore, it is possible to suppress the contact of the bucket 30 and the holding pin 25 to the minimum when a centrifugal separation operation is not performed, and to reduce a friction force between the bucket 30 and the holding pin 25.

[Second Exemplary Embodiment]

Figure 10:
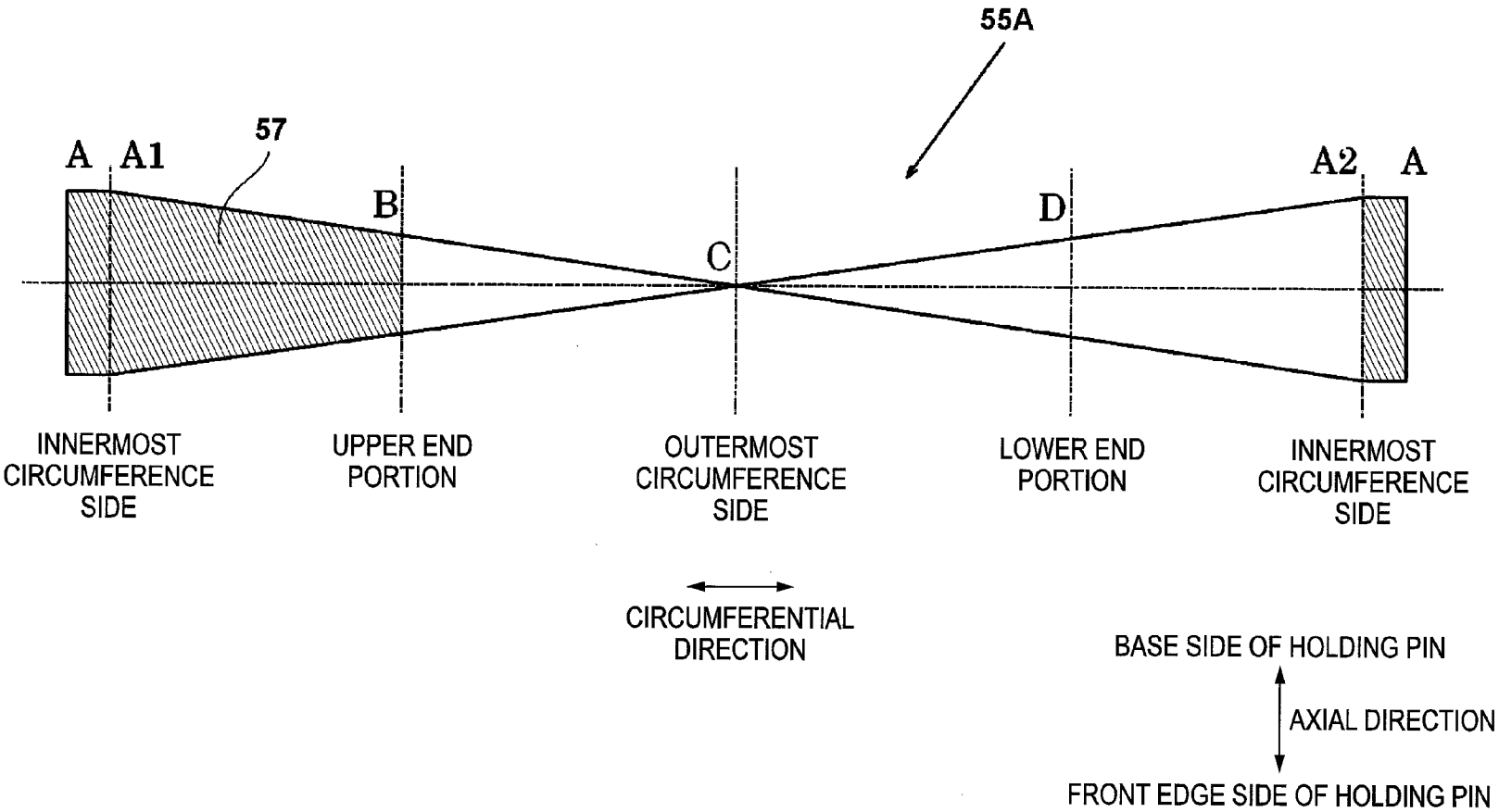
FIG. 10 is a development view illustrating an outer circumference surface of a holding pin according to a second exemplary embodiment of the present invention.

Hereinafter, a shape of a sliding portion 55A according to a second exemplary embodiment of the present invention will be described with reference to FIG. 10. FIG. 10 is a development view illustrating the sliding portion 55A according to the second exemplary embodiment of the present invention which corresponds to 360 degrees from the circumferential position A in the circumferential direction. In the second exemplary embodiment, the width of the sliding portion in the axial direction becomes minimum at the circumferential position C (outermost circumferential position) of the sliding portion 55A, and the width of the sliding portion in the axial direction becomes maximum at the circumferential position A (innermost circumferential position). A contact area of the sliding portion 55A with a bucket 30 becomes a portion 57 shown by hatching. Here, from the circumferential position A1 to the circumferential position A2, the width in the axial direction is constant. In order to make the width in the axial direction constant from the circumferential position A1 to the circumferential position A2, the holding pin is configured to have a partially deformed shape, not the complete circle shape as shown in FIG. 8.

[Third Exemplary Embodiment]

Figure 11:
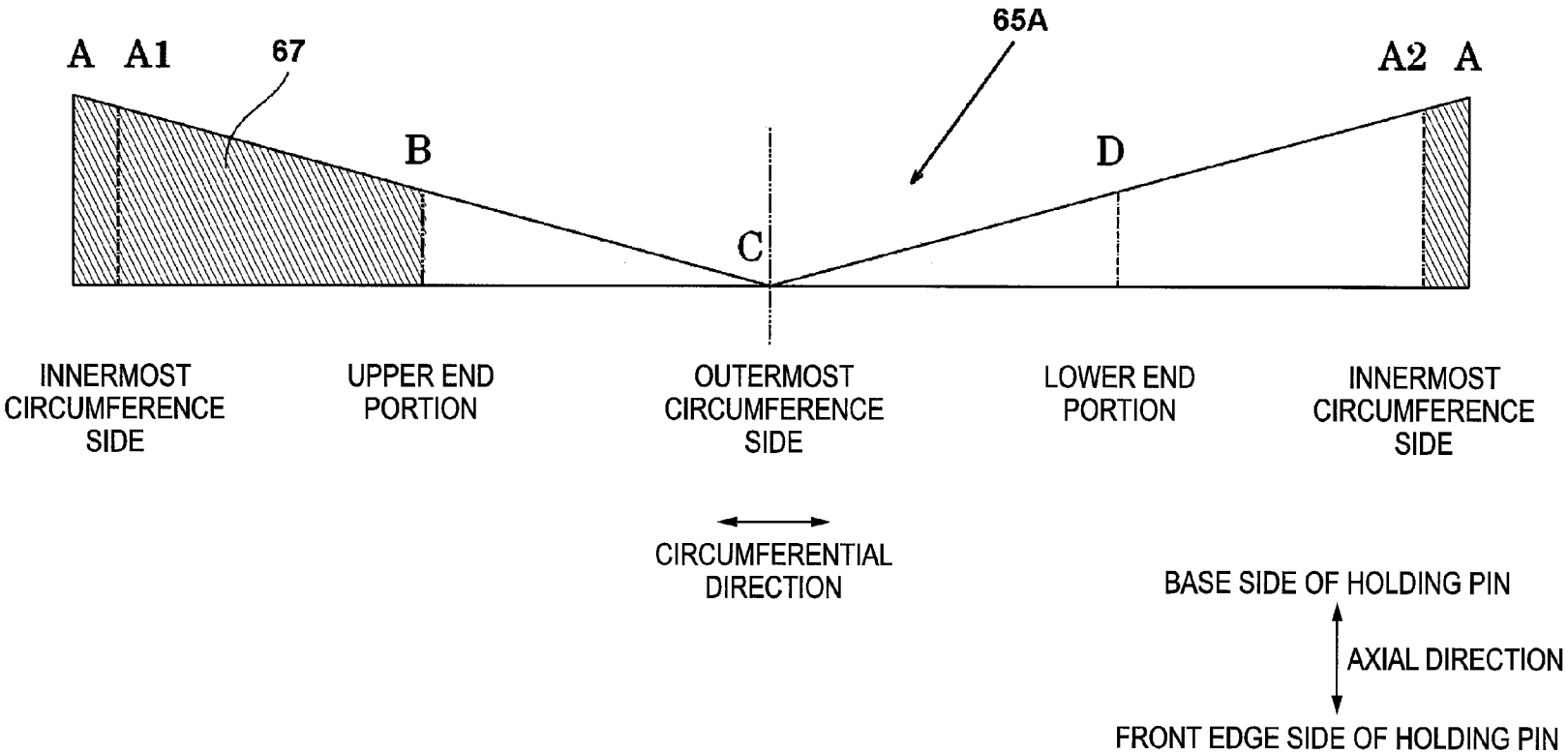
FIG. 11 is a development view illustrating an outer circumference surface of a holding pin according to a third exemplary embodiment of the present invention.

Hereinafter, a shape of a sliding portion 65A according to a third exemplary embodiment of the present invention will be described with reference to FIG. 11. FIG. 11 is a development view illustrating the sliding portion 65A according to the third exemplary embodiment of the present invention which corresponds to 360 degrees from the circumferential position A in the circumferential direction. In the third exemplary embodiment, the width of the sliding portion in the axial direction becomes minimum at the circumferential position C (outermost circumferential position) of the sliding portion 65A and the width of the sliding portion in the axial direction becomes maximum at the circumferential position A (innermost circumferential position). A contact area of the sliding portion 65A with a bucket 30 becomes a portion 67 shown by hatching. The width in the axial direction is not constant from the circumferential position A1 to the circumferential position A2, but becomes maximum at the circumferential position A. Therefore, the construction of the shape of the holding pin by the precision casting becomes simplest.

[Fourth Exemplary Embodiment]

Figure 12:
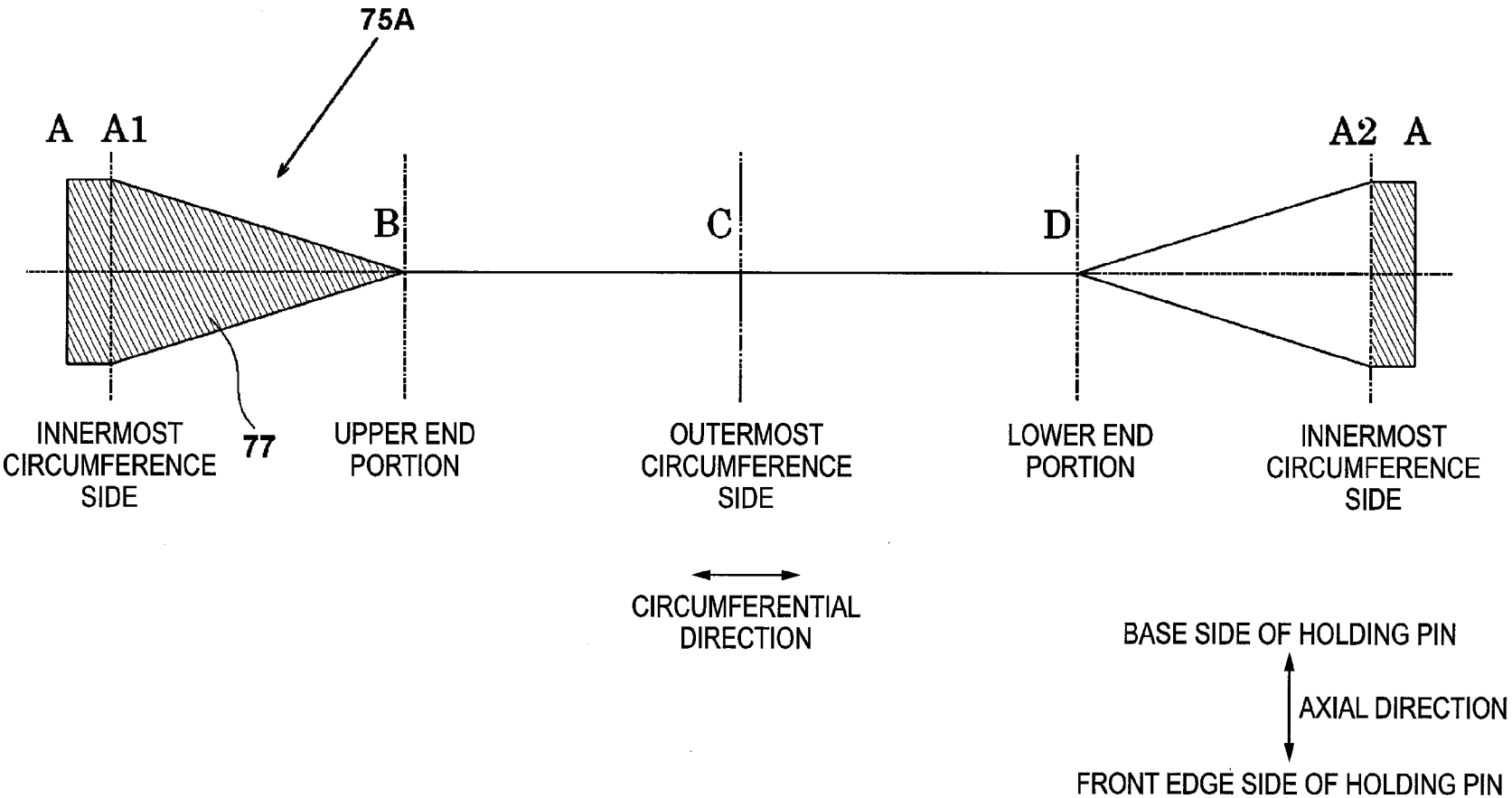
FIG. 12 is a development view illustrating an outer circumference surface of a holding pin according to a fourth exemplary embodiment of the present invention.

Hereinafter, a shape of a sliding portion 75A according to a fourth exemplary embodiment of the present invention will be described with reference to FIG. 12. FIG. 12 is a development view illustrating the sliding portion 75A according to the fourth exemplary embodiment of the present invention which corresponds to 360 degrees from the circumferential position A in the circumferential direction. In the fourth exemplary embodiment, the width of the sliding portion in the axial direction becomes minimum at the circumferential positions B to D of the sliding portion 75A and the width of the sliding portion 75A in the axial direction increases from the circumferential position B to the circumferential position A1 and from the circumferential position D to the circumferential position A2. A contact area of the sliding portion 75A with a bucket 30 is a portion 77 shown by hatching. Here, from the circumferential position A1 to the circumferential position A2, the width in the axial direction is constant. Further, the sliding portion is configured such that the width of the sliding portion in the axial direction is close to 0, that is, the sliding portion has a spherical shape, in a portion from the circumferential position B to the circumferential position D which rarely influences the sliding of the holding pin and the bucket 30. According to this configuration, it is possible to make a cutting process area for forming the sliding portion 75A to be small.

As described above, according to the present invention, even in a case where the center of gravity of the rack 38 is not in alignment with the center axis of the pin receiving portion 34 such that the bucket 30 does not swing up to a horizontal direction, since the pin receiving portion 34 and the sliding portion 25A reliably maintains the line contact, it is possible to implement a swing rotor for a centrifugal separator and a centrifugal separator capable of reducing instability of the swing state due to an increase in surface pressure by the centrifugal force and performing a centrifugal separation operation in a stable state.

Although the present invention has been described on the basis of the exemplary embodiments, the present invention is not limited by the above-described exemplary embodiments, but may be variously modified without departing from the scope of the present invention. For example, in the above-mentioned exemplary embodiments, examples of the swing rotor having holding pins for swing formed at the swing body side have been described. However, the present invention can be similarly applied to a swing rotor having holding pins attached at the bucket side, not at the swing body side. In the above-mentioned exemplary embodiments, the rotor body extending in a star shape disposed around the hub has the arms formed around front edges thereof. However, the shape of the rotor body is not limited thereto, but may have other arbitrary shapes. For example, a rotor body may be configured to have an almost circular shape as seen from the above, parallel cut grooves (surfaces facing the grooves correspond to the arms) formed at a plurality of positions of the rotor body (for example, four positions at intervals of 90 degrees) to extend in a diametrical direction and form a space allowing a bucket with a small diameter to swing, and holding pins extending from the arm portions.

The present invention provides illustrative, non-limiting aspects as follows:

(1) In a first aspect, there is provided a swing rotor for a centrifugal separator, the swing rotor including: a hub configured to be connected to a drive shaft; and a rotor body disposed around the hub, wherein a plurality of pairs of arms are disposed at the rotor body such that arms of each pair face each other, wherein a holding pin configured to hold a bucket such that the bucket is capable of swinging is disposed to the arm such that the holding pin extends toward an arm facing the arm to which the holding pin is disposed, wherein an engagement portion which is configured to be supported by the holding pin is formed to the bucket, and wherein a sliding surface of the holding pin with an engagement portion of the bucket is formed such that a width of a contact area, which is an area that the holding pin contacts with the engagement portion of the bucket, in an axial direction when the bucket does not swing differs from a width of the contact area in the axial direction when the bucket reaches a horizontal position by swinging during a centrifugal separation operation.

According to the first aspect, the sliding surface of the holding pin configured to support the engagement portion of the bucket is configured such that the width of the contact area in the axial direction when the bucket does not swing differs from the width of the contact area in the axial direction when the bucket reaches a horizontal position by swinging during a centrifugal separation operation. Therefore, in a state in which the swing rotor stops, it is possible to reduce the contact length of the holding pin and the pin receiving portion of the bucket so as to reduce friction resistance by the contact such that the bucket smoothly swings.

(2) In a second aspect, there is provided the swing rotor for a centrifugal separator according to the first aspect, wherein the width of the contact area in the axial direction when the bucket does not swing is smaller than the width of the contact area in the axial direction when the bucket reaches the horizontal position by swinging.

According to the second aspect, the width of the contact area in the axial direction when the bucket does not swing is smaller than the width of the contact area in the axial direction when the corresponding bucket reaches the horizontal position by swinging. Therefore, if the swing rotor rotates such that the bucket swings up to a horizontal position, it is possible to ensure a sufficient contact length, thereby reducing a surface pressure of the holding pin and the pin receiving portion of the bucket during a centrifugal separation operation.

(3) In a third aspect, there is provided the swing rotor for a centrifugal separator according to the second aspect, wherein the width of the contact area in the axial direction continuously increases when the bucket moves from a position where the bucket does not swing to the horizontal position.

According to the third aspect, the width of the contact area in the axial direction continuously increases when the bucket moves from a position when the bucket does not swing to the horizontal position. Therefore, it is possible to ensure a sufficient length of the contact of the holding pin and the pin receiving portion of the bucket during a centrifugal separation operation, thereby reducing a surface pressure.

(4) In a fourth aspect, there is provided the swing rotor for a centrifugal separator according to the third aspect, wherein a rate at which the width of the contact area in the axial direction continuously increases is constant.

According to the fourth aspect, a rate at which the width of the contact area in the axial direction continuously increases is constant. Therefore, a smooth swing of the bucket is possible and thus it is possible to improve the reliability in the swinging of the bucket.

(5) In a fifth aspect, there is provided the swing rotor for a centrifugal separator according to the third aspect, wherein the rate at which the width of the contact area in the axial direction continuously increases is not constant.

According to the fifth aspect, the rate at which the width of the contact area in the axial direction continuously increases is not constant. Therefore, it is possible to implement a holding pin having a sliding surface in which there is a variation between a portion where it is intended to ensure a sufficient contact area and a portion where a small contact area is enough.

(6) In a sixth aspect, there is provided the swing rotor for a centrifugal separator according to the fourth or fifth aspect, wherein the holding pin is formed by integral molding with the arm.

According to the sixth aspect, the holding pin may be formed by integral molding with the arm. Therefore, it is possible to implement a swing rotor having superior strength and high durability.

(7) In a seventh aspect, there is provided the swing rotor for a centrifugal separator according to any one of the first to sixth aspects, wherein the bucket includes a pin receiving portion having an inner wall portion of a semi-cylindrical shape larger than the outermost diameter of the holding pin.

According to the seventh aspect, the bucket may include a pin receiving portion having an inner wall portion of a semi-cylindrical shape larger than the outermost diameter of the holding pin. Therefore, it is possible to easily hang a bucket on the swing rotor only by moving the bucket from the upper side to the lower side of the pin receiving portions.

(8) In an eighth aspect, there is provided a centrifugal separator including: a swing rotor that holds a plurality of buckets for holding samples such that the buckets are capable of swinging, the swing rotor including, a hub configured to be connected to a drive shaft; a rotor body disposed around the hub; the plurality of buckets that are held by the swing rotor such that the buckets are capable of swinging; a drive that rotates the swing rotor; and a rotor chamber where a rotation shaft of the drive is disposed and that is for rotating the swing rotor, wherein a plurality of pairs of arms are disposed at the rotor body such that arms of each pair face each other, wherein a holding pin configured to hold the bucket such that the bucket is capable of swinging is disposed to the arm such that the holding pin extends toward an arm facing the arm to which the holding pin is disposed, wherein an engagement portion which is configured to be supported by the holding pin is formed to the bucket, and wherein a sliding surface of the holding pin with an engagement portion of the bucket is formed such that a width of a contact area, which is an area that the holding pin contacts with the engagement portion, in an axial direction when the bucket does not swing differs from a width of the contact area in the axial direction when the bucket reaches a horizontal position by swinging during a centrifugal separation operation.

According to the eighth aspect, a sliding surface of the holding pin with the bucket is formed such that the width of the contact area in an axial direction when the bucket does not swing differed from the width of the contact area in the axial direction when the bucket reaches a horizontal position by swinging during a centrifugal separation operation. Therefore, in a state in which the swing rotor stops, it is possible to implement a centrifugal separator capable of reducing the length of the contact of the holding pin and the pin receiving portion of the bucket so as to reduce friction resistance by the contact such that the bucket smoothly swings.

(9) In the ninth aspect, there is provided the centrifugal separator according to the eighth aspect, wherein the width of the contact area in the axial direction when the bucket does not swing is smaller than the width of the contact area in the axial direction when the bucket reaches the horizontal position by swinging.

According to the ninth aspect, the width of the contact area in the axial direction when the corresponding bucket does not swing is smaller than the width of the contact area in the axial direction when the corresponding bucket reaches the horizontal position by swinging. Therefore, in sliding in the vicinity of a standing state of the swing rotor, it is possible to reduce the friction resistance, and if the swing rotor rotates such that the bucket swings up to a horizontal position, it is possible to ensure a sufficient contact length, thereby reducing a surface pressure of the holding pin and the pin receiving portion of the bucket, and thus to provide a stable centrifugal separator.

(10) In the tenth aspect, there is provided the centrifugal separator according to the ninth aspect, wherein the width of the contact area in the axial direction continuously increases when the bucket moves from a position where the bucket does not swing to the horizontal position.

According to the second aspect, the width of the contact area in the axial direction may continuously increase from a position where the bucket does not swing to the horizontal position. Therefore, it is possible to ensure a sufficient length of the contact of the holding pin and the pin receiving portion of the bucket during a centrifugal separation operation, and thus to implement a centrifugal separator with a reduced surface pressure.

What is claimed is:

1. A swing rotor for a centrifugal separator, the swing rotor comprising:

a hub configured to be connected to a drive shaft; and a rotor body disposed around the hub, wherein a plurality of pairs of arms are disposed at the rotor body such that arms of each pair face each other, wherein a holding pin configured to hold a bucket such that the bucket is capable of swinging is disposed to the arm such that the holding pin extends toward an arm facing the arm to which the holding pin is disposed, wherein an engagement portion which is configured to be supported by the holding pin is formed to the bucket, and wherein a sliding surface of the holding pin with an engagement portion of the bucket is formed such that a width of a contact area, which is an area that the holding pin contacts with the engagement portion of the bucket, in an axial direction of the holding pin when the bucket does not swing differs from a width of the contact area in the axial direction when the bucket reaches a horizontal position by swinging during a centrifugal separation operation.

2. The swing rotor for a centrifugal separator according to claim 1, wherein the width of the contact area in the axial direction when the bucket does not swing is smaller than the width of the contact area in the axial direction when the bucket reaches the horizontal position by swinging.

3. The swing rotor for a centrifugal separator according to claim 2, wherein the width of the contact area in the axial direction continuously increases when the bucket moves from a position where the bucket does not swing to the horizontal position.

4. The swing rotor for a centrifugal separator according to claim 3, wherein a rate at which the width of the contact area in the axial direction continuously increases is constant.

5. The swing rotor for a centrifugal separator according to claim 3, wherein the rate at which the width of the contact area in the axial direction continuously increases is not constant.

6. The swing rotor for a centrifugal separator according to claim 4, wherein the holding pin is formed by integral molding with the arm.

7. The swing rotor for a centrifugal separator according to claim 1, wherein the bucket includes a pin receiving portion having an inner wall portion of a semi-cylindrical shape larger than the outermost diameter of the holding pin.

8. A centrifugal separator comprising:

a swing rotor that holds a plurality of buckets for holding samples such that the buckets are capable of swinging, the swing rotor including, a hub configured to be connected to a drive shaft;

a rotor body disposed around the hub;

the plurality of buckets that are held by the swing rotor such that the buckets are capable of swinging;

a drive that rotates the swing rotor; and a rotor chamber where a rotation shaft of the drive is disposed and that is for rotating the swing rotor, wherein a plurality of pairs of arms are disposed at the rotor body such that arms of each pair face each other, wherein a holding pin configured to hold the bucket such that the bucket is capable of swinging is disposed to the arm such that the holding pin extends toward an arm facing the arm to which the holding pin is disposed, wherein an engagement portion which is configured to be supported by the holding pin is formed to the bucket, and wherein a sliding surface of the holding pin with an engagement portion of the bucket is formed such that a width of a contact area, which is an area that the holding pin contacts with the engagement portion, in an axial direction of the holding pin when the bucket does not swing differs from a width of the contact area in the axial direction when the bucket reaches a horizontal position by swinging during a centrifugal separation operation.

9. The centrifugal separator according to claim 8, wherein the width of the contact area in the axial direction when the bucket does not swing is smaller than the width of the contact area in the axial direction when the bucket reaches the horizontal position by swinging.

10. The centrifugal separator according to claim 9, wherein the width of the contact area in the axial direction continuously increases when the bucket moves from a position where the bucket does not swing to the horizontal position.

* * * * *